US006493991B1

(12) United States Patent
Hamada et al.

(10) Patent No.: US 6,493,991 B1
(45) Date of Patent: Dec. 17, 2002

(54) REVOLVING DOOR SYSTEM

(75) Inventors: Yoshinori Hamada, Hyogo-ken (JP); Hiroyuki Yokotachi, Hyogo-ken (JP)

(73) Assignee: Nabco Limited, Kobe (JP)

( * ) Notice: Subject to any disclaimer, the term of this patent is extended or adjusted under 35 U.S.C. 154(b) by 0 days.

(21) Appl. No.: 09/689,559

(22) Filed: Oct. 12, 2000

(30) Foreign Application Priority Data

Nov. 2, 1999 (JP) ..... 11-313001

(51) Int. Cl.[7] ..... E05D 15/02
(52) U.S. Cl. ..... 49/42; 49/43
(58) Field of Search ..... 49/42, 43; 109/2, 109/3, 5, 6, 7, 8, 9

(56) References Cited

U.S. PATENT DOCUMENTS

| | | | | | |
|---|---|---|---|---|---|
| 619,674 | A | * | 2/1899 | Cobb | 49/208 |
| 732,982 | A | * | 7/1903 | Wendler | 49/68 |
| 3,353,298 | A | * | 11/1967 | Pfender et al. | 49/43 |
| 4,341,165 | A | * | 7/1982 | Calandritti et al. | 109/8 |
| 4,586,441 | A | * | 5/1986 | Zekich | 109/8 |
| 5,076,013 | A | * | 12/1991 | Gallenschutz et al. | 49/42 |
| 5,159,203 | A | * | 10/1992 | Gallenschutz et al. | 307/116 |
| 5,987,817 | A | * | 11/1999 | Hein | 49/40 |

FOREIGN PATENT DOCUMENTS

| | | | |
|---|---|---|---|
| JP | 53-20049 | * | 2/1978 |
| JP | SHO 60-177277 U | | 11/1985 |
| JP | 06-108735 | | 4/1994 |

* cited by examiner

*Primary Examiner*—Gregory J. Strimbu
(74) *Attorney, Agent, or Firm*—Duane Morris LLP

(57) ABSTRACT

A revolving door system includes outer walls (2) disposed in parallel with a doorway in a building. A hollow center core (3) having a racetrack-shaped cross-section is disposed between the outer walls, whereby passageways are defined by the lower surface **(4*a*) of a ceiling (4), the floor, the center core and the outer walls. Upper and lower rails (10) and (11) are secured within the center core, and with which plural sets of upper and lower suspension devices (13) and (14) are movable engaged. A plurality of doors (12) are supported by the upper and lower suspension devices. A pulling bar (56) is linked to the upper suspension device for each door. The pulling bars are connected to a driving chain (75) driven to move by a door driving arrangement. A carrier bar (15) is connected to each upper suspension device, for rotatably supporting the upper portion of each door at a location near the center core. The lower portion of each door is rotatably supported by one of the lower suspension devices. An electromagnetic locking arrangement (51)** detachably holds the upper portion of each door with respect to the carrier bar at a location remote from the center core.

8 Claims, 10 Drawing Sheets

13(14)
29
31
30
10(11)
30
32

13(14)
10C
10C
29
32

13(14)
29
30
37
37

13(14)
29
32
34
35
31
30
33
33
36
10
(11)
33
36
35
31
32
34

REVOLVING DOOR SYSTEM

This invention relates to a revolving door system including doors moving along a racetrack-shaped path, and, more particularly, a supporting structure for such doors.

BACKGROUND OF THE INVENTION

A conventional revolving door system including four doors radially extending from a vertically extending center supporting shaft has a disadvantageously narrow space defined between adjacent doors. Jacob Robert Alfred Hoover et al. filed a Japanese patent application, laid open for public inspection as Japanese Unexamined Patent Publication (KOKAI) No. SHO 56-481 A on Jan. 6, 1981, claiming a priority from Dutch Patent Application No. 7902203 filed on Mar. 21, 1979. In this patent publication, they proposed a revolving door system free of the above-described disadvantage of conventional revolving doors. The doors of Japanese Unexamined Patent Publication (KOKAI) No. SHO 56-481 A do not revolve along a circular path, but they move along a racetrack-shaped path defined by two parallel straight lines and two arcs each connecting the ends of the two straight lines on the same side. Each door is supported by a frame. Although the details of the structure of the revolving door system is not clearly shown in the patent publication, it seems that each door frame of the system, as best understood, includes a vertically extending member and horizontal members extending from the top and bottom ends of the vertical member. One of the longer sides of the door is connected to the vertical member with hinges. The door is supported in such a manner that free rotation of the door about the hinges is prevented by some restraining means operating from spring force.

The door system of the Japanese patent publication has a disadvantage that it cannot withstand against a large external force exerted to the doors. When, for example, some large wind pressure is exerted to the door, it may rotate open about the hinges since the rotation restraining means acts on the side of the door where the hinges are attached. Therefore it is desirable that the doors can withstand such external force exerted to them.

In addition, it is desired that revolving door systems have many other functions, but it is important that provision of such functions should not deface the door system since it may be installed in the doorway of a building which is exposed to public.

An object of the present invention is to provide a revolving door system which can withstand wind pressure of some magnitude, and which is provided with many functions and still has an esthetically good appearance.

SUMMARY OF THE INVENTION

According the present invention, a revolving door system is provided. The revolving door system includes outer walls disposed in parallel with a doorway in a building wall and connected to the building wall. A hollow center core is disposed between the outer walls, and it includes parallel straight portions which have a length substantially equal to the length of the outer walls and are in parallel with the outer walls. The center core further includes two arcuate end portions each connecting respective two adjacent ends of the straight portions. A ceiling member is disposed to extend above the center core and the outer walls across the doorway. The ceiling member, the floor of the doorway, the center core and the outer walls defining two passageways. Parallel, spaced upper and lower rails are disposed within the center core. The rails extend horizontally in parallel with the outer surface of the center core. Plural sets of upper and lower suspension devices are disposed one for each door. The upper and lower suspension devices movably engage with the upper and lower rails, respectively, so as to move along them. A plurality of doors are supported by the respective sets of upper and lower suspension devices so as to be movable through the passageways. A plurality of pulling bars are secured to the respective upper suspension devices. A door driving chain driven by a door driving arrangement is connected to the respective pulling bars.

A door supporting structure for supporting each of the doors includes a carrier bar. The carrier bar is coupled to each of the upper suspension devices. Each carrier bar extends in parallel with the ceiling member and has a length substantially equal to the width of the door. The upper portion of each door is rotatably carried by the carrier bar at a location near the center core. The lower portion of each door is rotatably supported by the lower suspension device at a location near the center core.

The upper portion of each door is detachably held by the associated carrier bar at a location remote from the location where the door is carried by the carrier bar.

Since each door is supported at two points along its upper portion and at one point along the lower portion, it can have an improved resistance to external force, such as wind pressure.

According to a second feature of the present invention, the revolving door system includes vertical supports, one for each door. Each vertical support extends in parallel with the outer surface of the center core. The upper end of the vertical support is secured to the center-core side of the carrier bar for that door, while its lower end is connected to the lower suspension device for that door. Each door is disposed with its longer sides extending along the vertical support. The upper portion of the door is rotatably supported at a location near to the vertical support by the carrier bar, while the lower portion of the door is rotatably supported by the lower suspension device. The upper side of each door is detachably held by the carrier bar at a location remote from the location where the door is rotatably supported by the carrier bar.

According to the second feature, by virtue of the use of the vertical supports, the respective carrier bars are firmly held by the associated vertical supports and the associated upper and lower suspension devices, and, therefore, the resistance of each door against external force is further improved.

The detachable holding of the upper portion of each door by the carrier bar may be provided by means of an electromagnetic locking arrangement. When the electromagnetic locking arrangement is energized, the door is held at three points so as to exhibit an improved resistance to external force, and when the electromagnetic locking arrangement is deenergized, the door can be swung open about an axis located near the center core.

According to a third feature, each of the carrier bars is formed of a hollow member. The hollow carrier bar may house therein a bearing for rotatably supporting the associated door, an arrangement for detachably holding the door, a sensor for sensing an object immediately before the door, and other accessories. The placing of such components in the hollow carrier bars makes the revolving door system look tidy in appearance. A number of sensors required for forming a desired number or size of sensing regions may be disposed in the carrier bars. The sensors may be reflection-type optical sensors.

According to a fourth feature of the present invention, each of the carrier, bars is formed of a hollow member for housing therein a bearing for rotatably holding the upper portion of an associated door at a location near the center core. An automatic door closing arrangement is disposed for each door within and in parallel with the ceiling member. Each pulling bar has a linking member secured, together with the associated carrier bar, to the associated upper suspension device. The automatic door closing arrangement is disposed along the pulling bar, and is linked to the rotation shaft of the door through the linking member of the pulling bar. Since the automatic door closing arrangements are disposed above the ceiling and linked with the doors through the spaces within the carrier bars by the linking members, they are hidden from eyes of people using the revolving door system. Thus, the appearance of the system is kept neat and tidy.

According to a fifth feature of the invention, an error absorber is disposed between the door supporting structure and the upper or lower suspension device. The error absorber absorbs error which could occur in parallelism between the door supporting structure and the suspension devices during the door movement.

Due to variations in distance between the upper and lower suspension devices of the respective sets and variations in parallelism between the upper and lower rails, the engagement between the respective upper suspension devices and the upper rail and/or the engagement between the respective lower suspension devices and the lower rail may vary depending on the locations of the doors. For example, if the distance between the upper and lower rails increases at a certain point, the upper and lower suspension devices reaching that point leave away from each other, which results in undue force exerted to the door supporting structure. Without the error absorbers, such undue force may increase resistance against movement of the doors, resulting in local abrasion of the rails and the suspension devices or in damage in the door supporting structure and the suspension device. The error absorbers can absorb such error in parallelism.

BRIEF DESCRIPTION OF THE DRAWINGS

FIGS. 10A through 10D show a suspension system of the revolving door system shown in FIG. 1, in which FIG. 10A is a front view, FIG. 10B is a left side view, FIG. 10C is a cross-sectional view along the line 10C—10C in FIG. 10B, and FIG. 10D is a bottom view.

DETAILED DESCRIPTION OF EMBODIMENT

Figure 1:
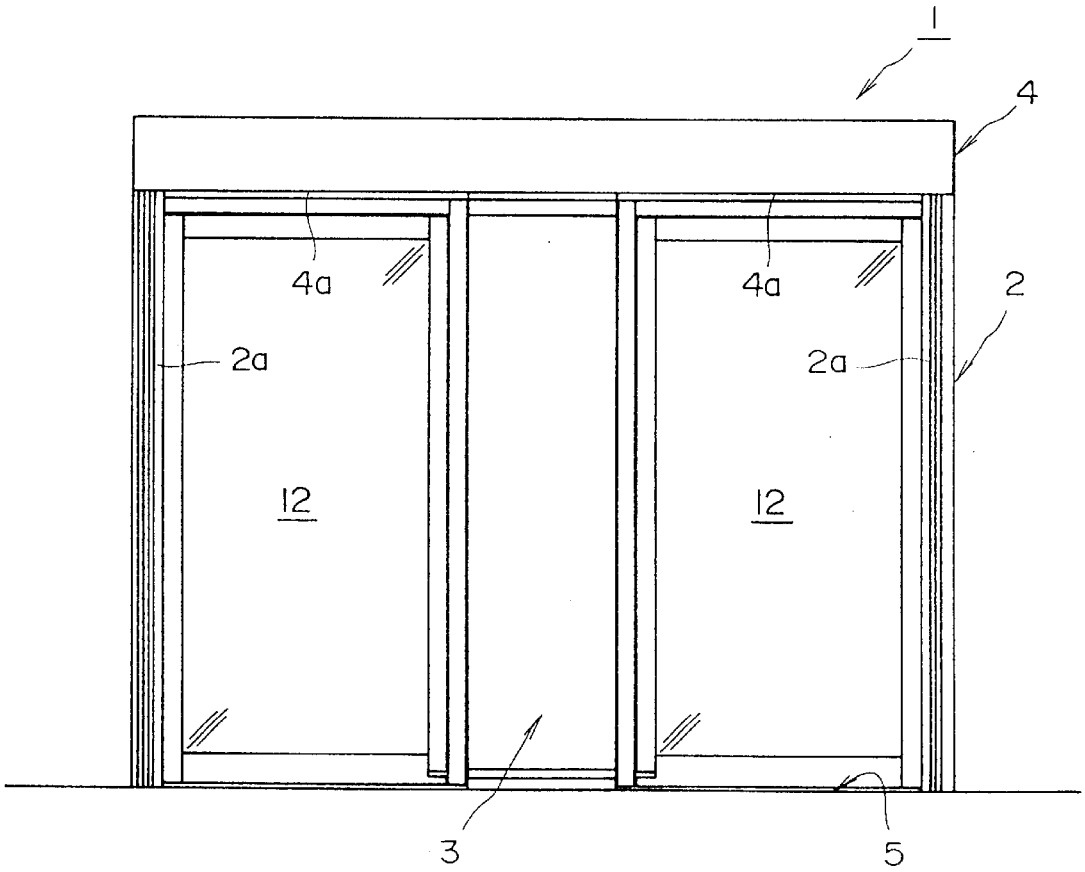
FIG. 1 is a front view of a revolving door system according to one embodiment of the present invention.
Figure 2:
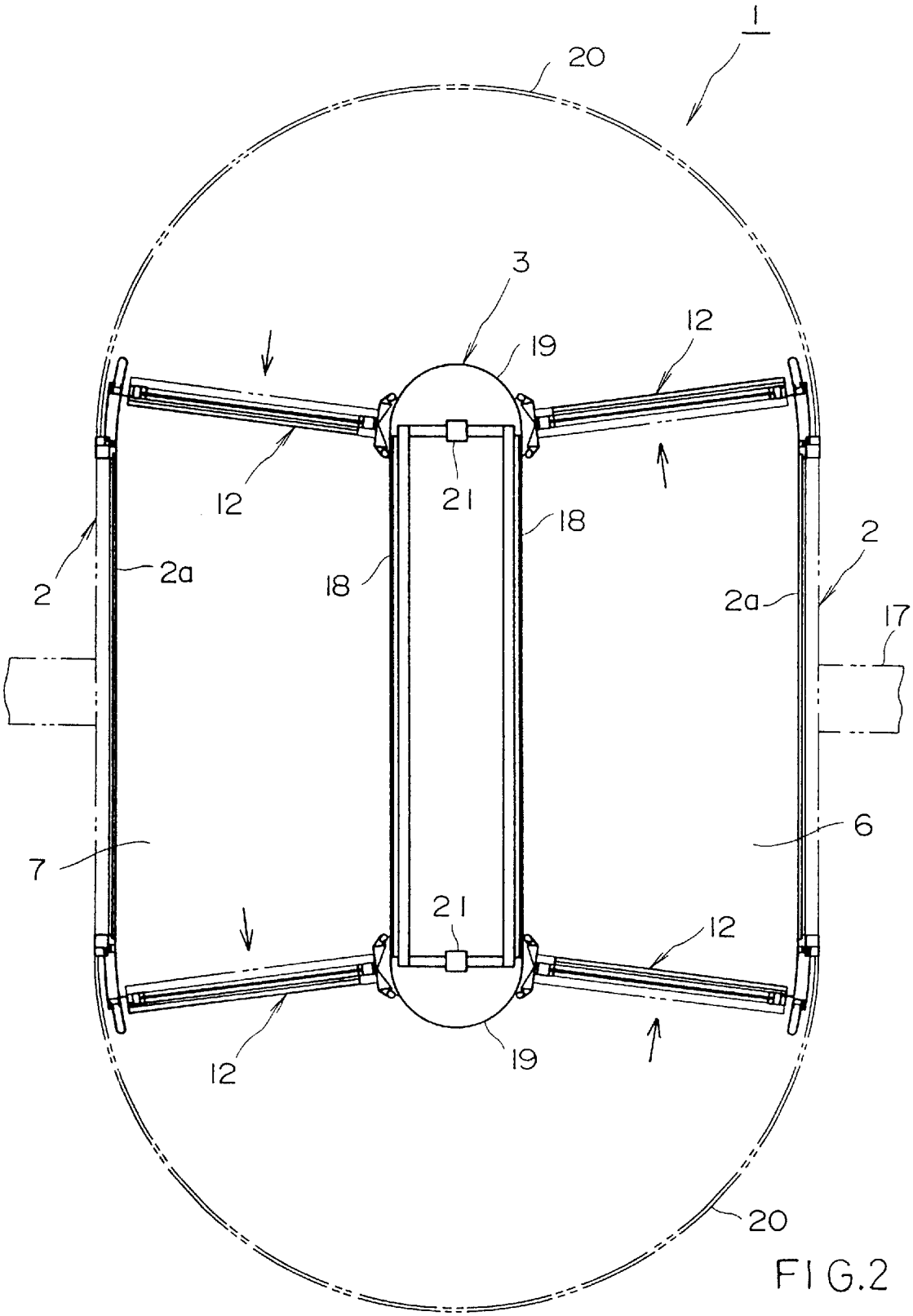
FIG. 2 is a schematic plan view illustrating the general structure of the revolving door system shown in FIG. 1.
Figure 3:
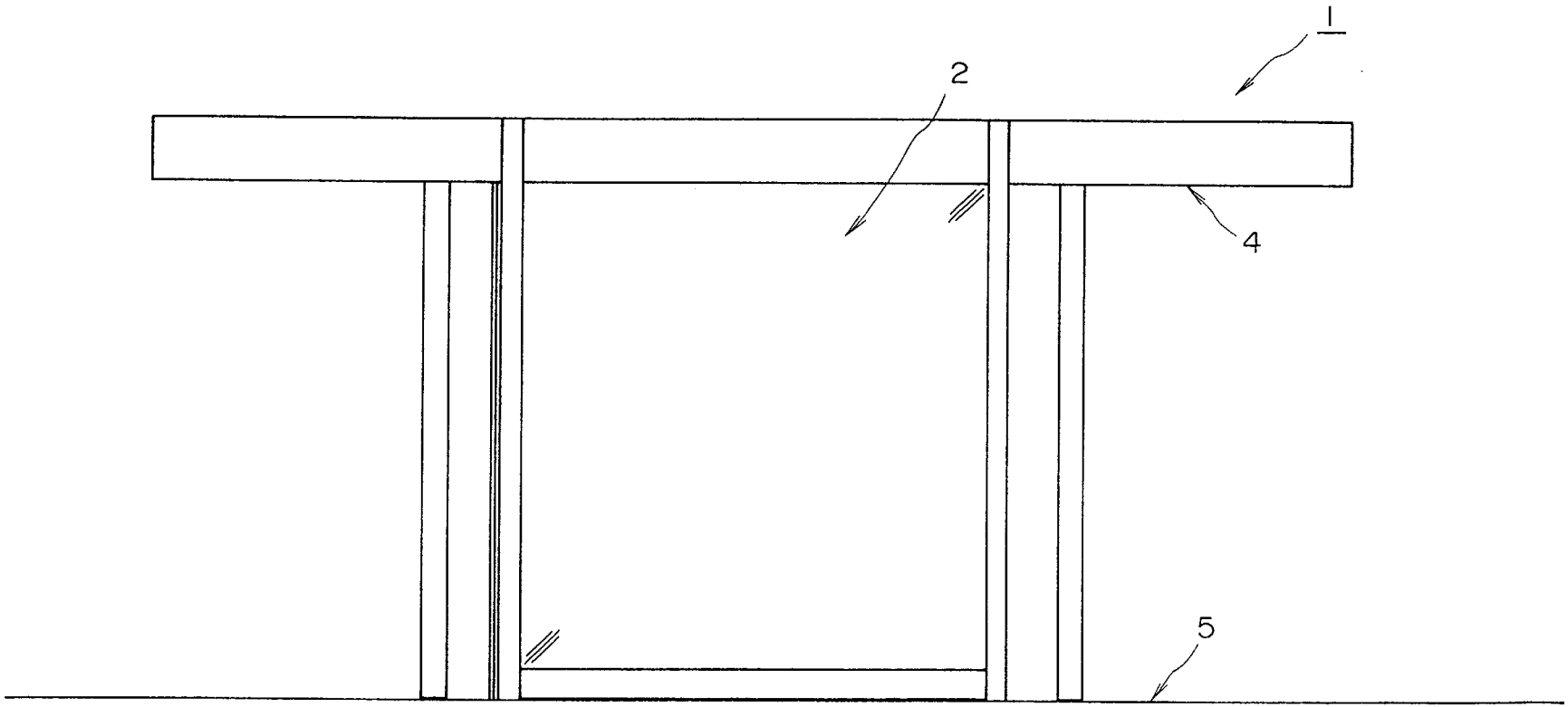
FIG. 3 is a schematic side elevational view of the revolving door system shown in FIG. 1.
Figure 4:
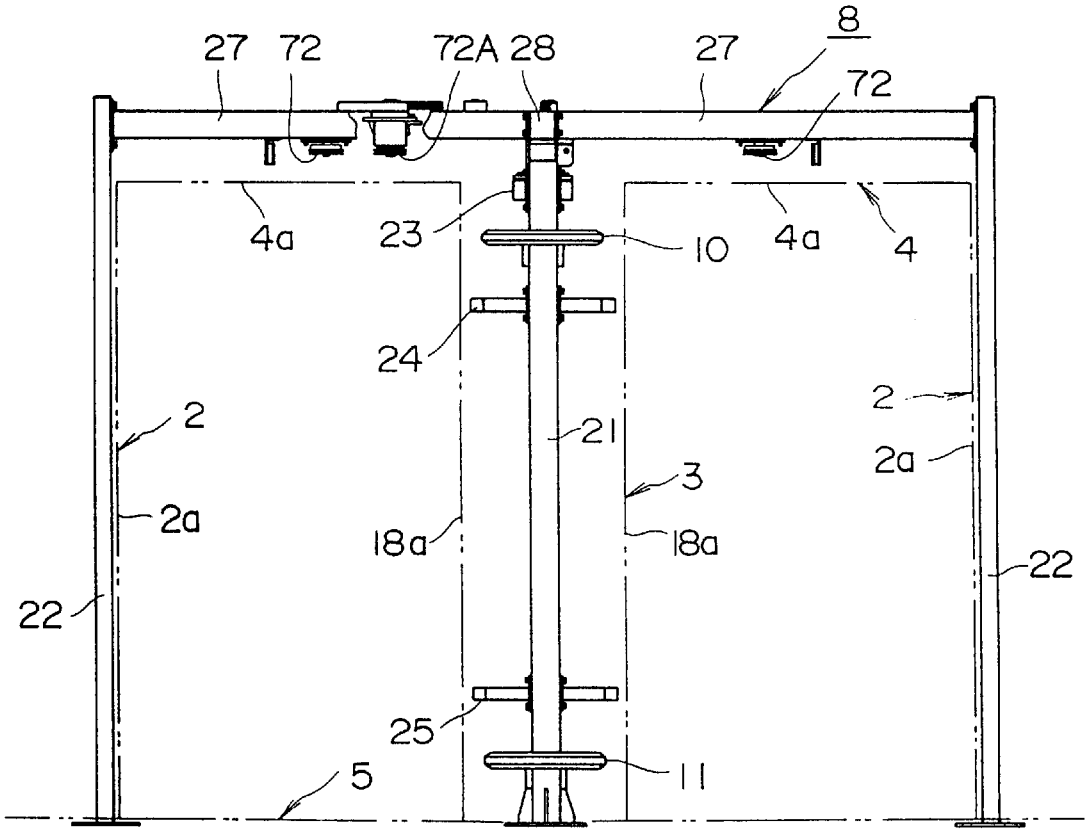
FIG. 4 is a schematic front view of the skeleton and some driving mechanism of the revolving door system shown in FIG. 1.
Figure 5:
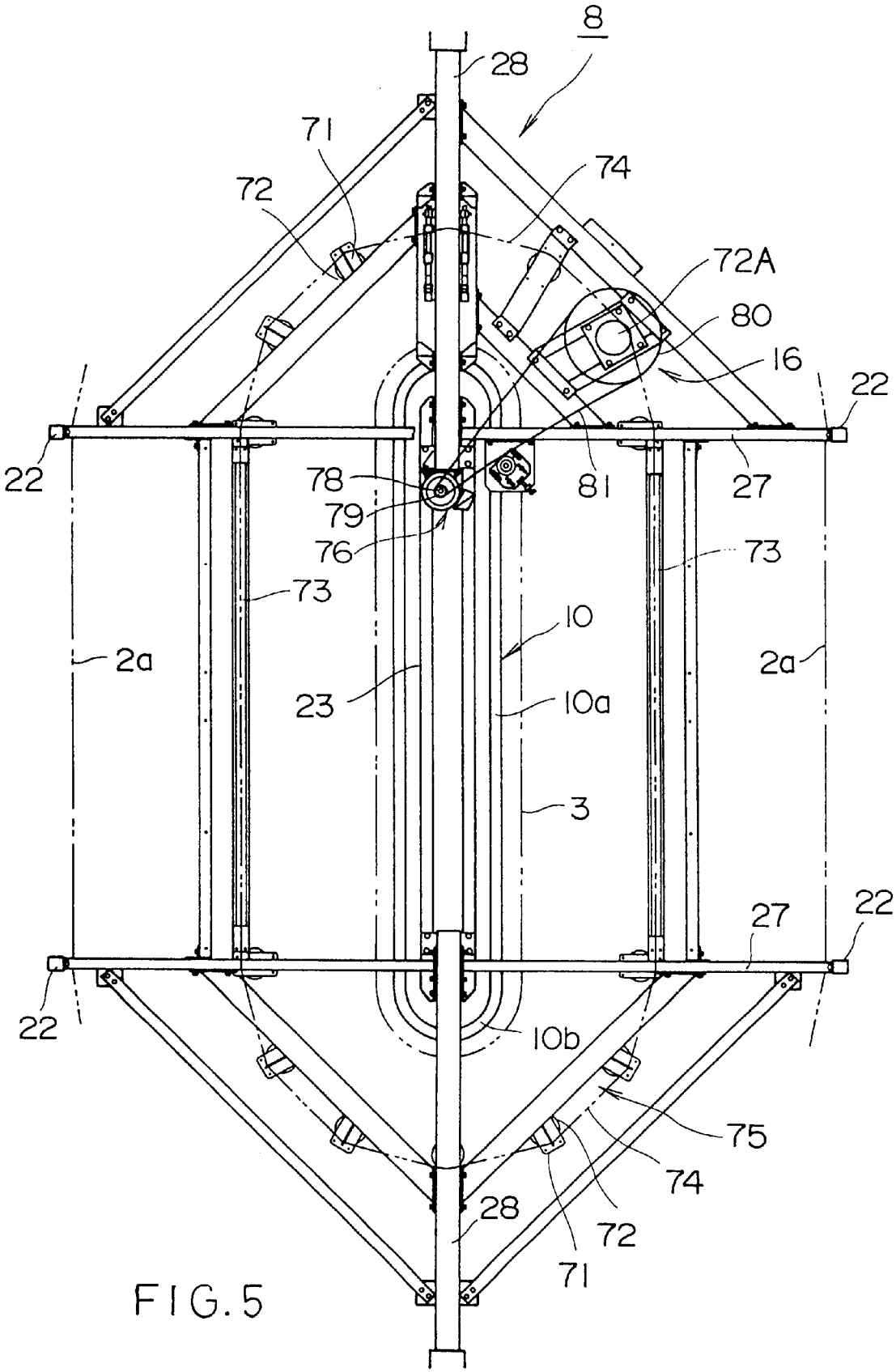
FIG. 5 is a schematic plan view of those portions shown in FIG. 4.
Figure 6:
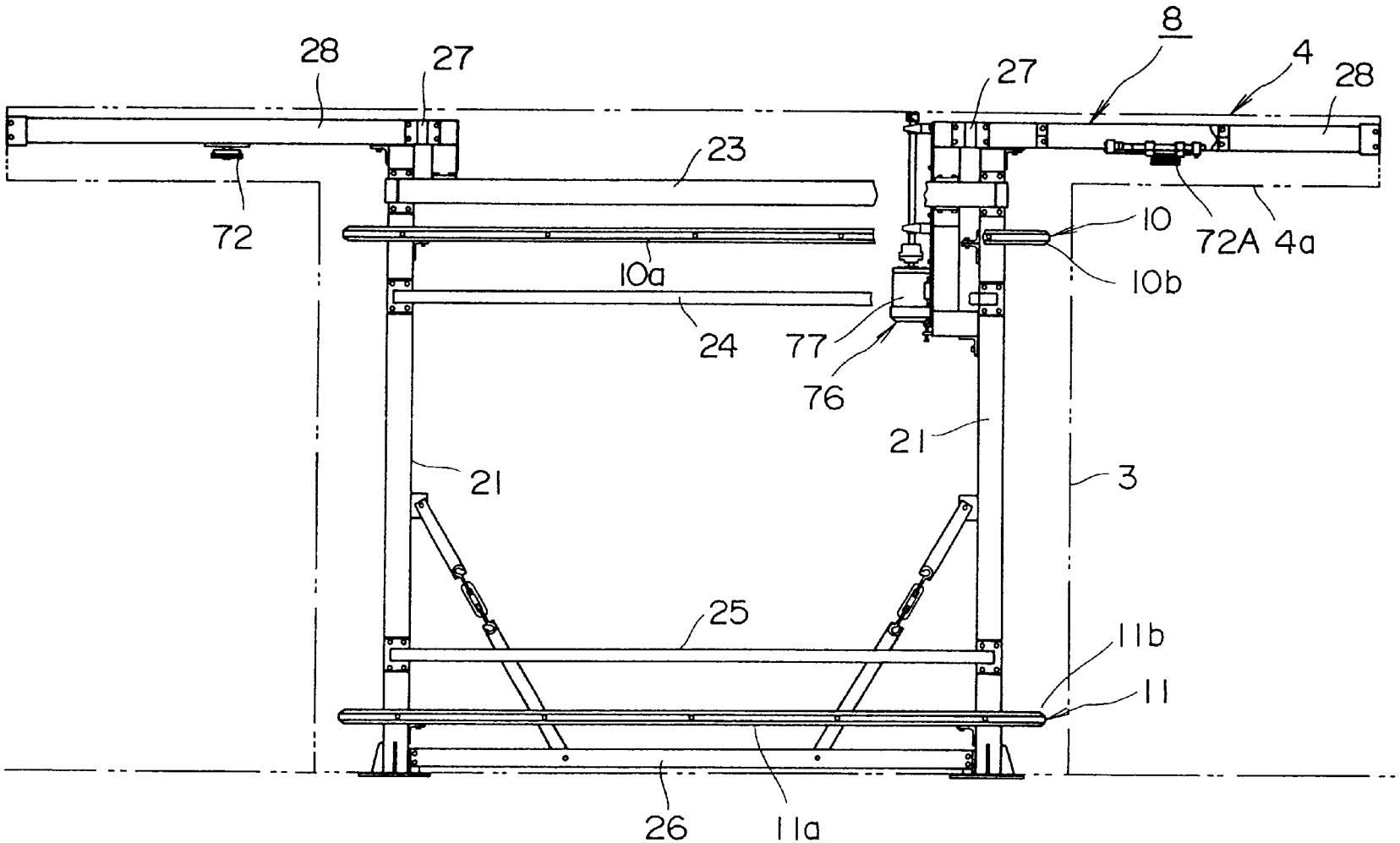
FIG. 6 is a side view of those portions shown in FIG. 4.

A revolving door system is installed in a doorway of a building. First, a general structure of a revolving door system 1 is described. As shown in FIGS. 1, 2 and 3, the revolving door system 1 includes two outer walls 2, a center core 3, a ceiling member 4 and a floor member 5, which define two parallel passageways 6 and 7 having the same cross-section. The center core 3 and the ceiling member 4 are mounted on a steel skeleton 8, as shown in FIGS. 4, 5 and 6. The revolving door system 1 also includes a door supporting arrangement 9. The door supporting arrangement 9 includes an upper rail 10 and a lower rail 11 mounted on the skeleton 8 within the center core 3, a set of upper and lower suspension devices 13 and 14 for each door 12. Each of the upper suspension devices 13 supports the upper portion of its associated door 12 via an associated carrier bar 15, and each of the lower suspension devices 14 supports the lower portion of its associated door 12. Each carrier bar 15 is movable along a predetermined path extending through the passageways 6 and 7. The carrier bars 15 and the associated doors 12 are driven by a door driving arrangement 16. Each door 12 has a size corresponding to the vertical cross-section of the passageways 6 and 7. Plural such doors 12 are used, and the same number of carrier bars 15 are used. In the illustrated example, four doors 12 and four carrier bars 15 are employed.

Now, the system is described in detail.

The building doorway is formed in an outer building wall 17. The outer walls 2 of the door system 1 are disposed in parallel with each other on opposite sides of the center core 3. A spacing equal to the width of the passageways 6 and 7 is disposed between the center core 3 and each of the outer walls 2. The outer walls 2 are connected to the building outer wall 17 at appropriate portions on their outer surfaces. As shown in FIG. 2, the center core 3 includes an enclosure wall formed of two parallel, straight portions 18 having a length substantially equal to the length of the outer walls 2, and two circular arcs 19 each connecting respective one ends of the straight portions 18. The enclosure wall has substantially the same height as the outer walls 2. The ceiling member 4 is hollow and has a predetermined thickness. It is disposed to lie on top of the center core 3 and the outer walls 2 on opposite sides of the center core 3. The ceiling member 4 has semicircular end portions 20 (shown in double phantom lines in FIG. 2) extending inward and outward of the building from the opposite ends of the passageways 6 and 7. The peripheral edges of the semicircular portions 20 substantially coincide with the path along which the outer edge of each door 12 follows when it turns. The floor member 5 is disposed to extend between the lower ends of the opposite sides of the center core and the lower ends of the outer walls 2, and also extend at least to the same extent as the ceiling member 4. The floor member 5 provides a continuous flat surface. Accordingly, as shown in FIGS. 1 and 2, the inner surfaces 2*a* of the outer walls 2, the outer surfaces 18*a* of the straight portions 18 of the center core 3, the lower surface 4*a* of the ceiling member 4 and the upper surface of the floor member 5 define the passageways 6 and 7 on the opposite sides of the center core 3. One of the passageways 6 and 7 is for entrance, and the other is for exit.

As shown in FIGS. 4, 5 and 6, the skeleton 8 includes two main pillars 21 disposed in the inner space of the center core 3, four corner pillars 22 at the four ends of the two outer walls 2, upper longitudinal beams 23 and 24, lower longitudinal beams 25 and 26, four upper transverse beams 27, two upper longitudinal beams 28, and reinforcing members. The upper and lower longitudinal beams 23–26 are disposed within the center core 3 and connect the two main pillars 21. The four upper transverse beams 27 are disposed within the space of the ceiling member 4. Two of the upper transverse beams 27 extend from each main pillar 21 in opposite directions and are connected to the upper ends of two of the four corner pillars 22. The two upper longitudinal beams 28 extend outward from the top ends of the respective ones of the two main pillars 21 into the respective semicircular end portions 20 of the ceiling member 4.

Figure 7:
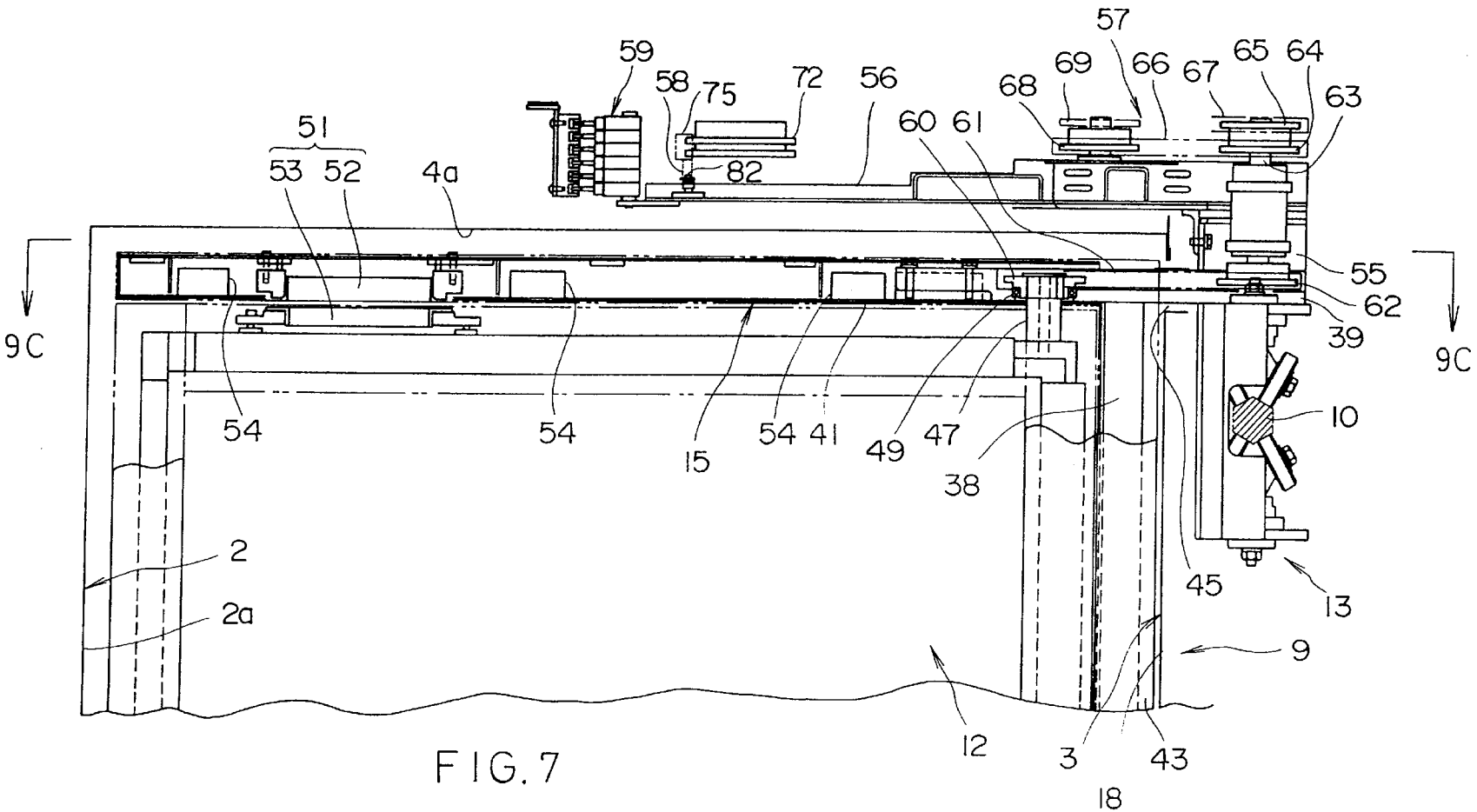
FIG. 7 is an enlarged partially broken view of the upper portion of one of the left-side doors of the revolving door system shown in FIG. 1.
Figure 8:
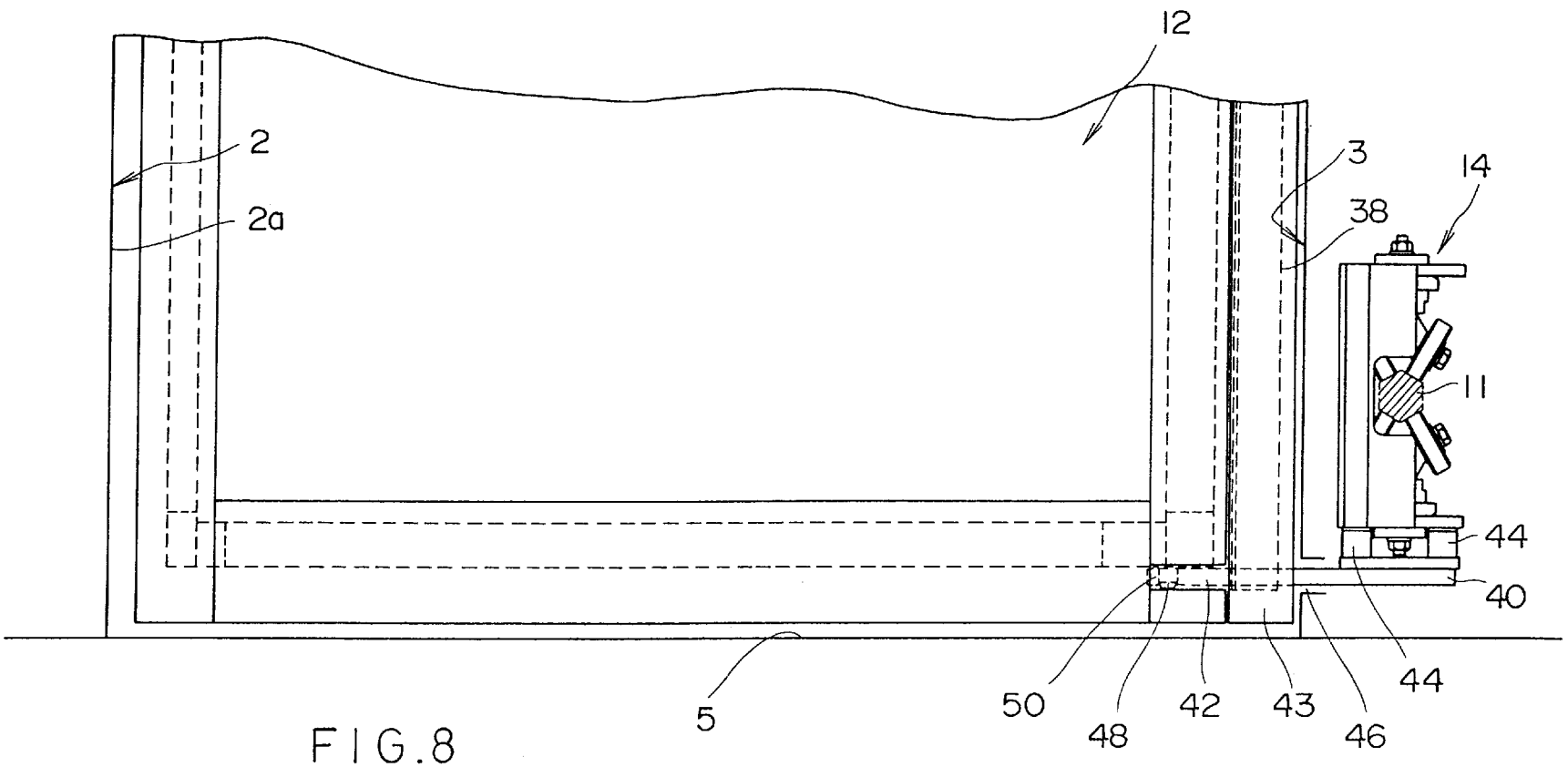
FIG. 8 is an enlarged partially broken view of the lower portion of the left-side door shown in FIG. 7.

The upper rail 10 and the lower rail 11 are secured to the skeleton 8 within the center core 3, as shown in FIGS. 4, 5 and 6. The upper rail 10 includes two parallel straight rail portions 10*a* and two semicircular end portions 10*b* each connecting the ends of the straight rail portions 10*a* on the same side. Similarly, the lower rail 11 includes two parallel straight rail portions 11*a* and two semicircular end portions 11*b* each connecting the ends of the straight rail portions 11*a* on the same side. The upper and lower rails 10 and 11 are of the same size and shape and are vertically spaced in parallel with each other. Each of the upper and lower rails 10 and 11 is formed of a rod having a hexagonal cross-section, as shown in FIGS. 7 and 8.

Figures 10A, 10B, 10C, 10D:
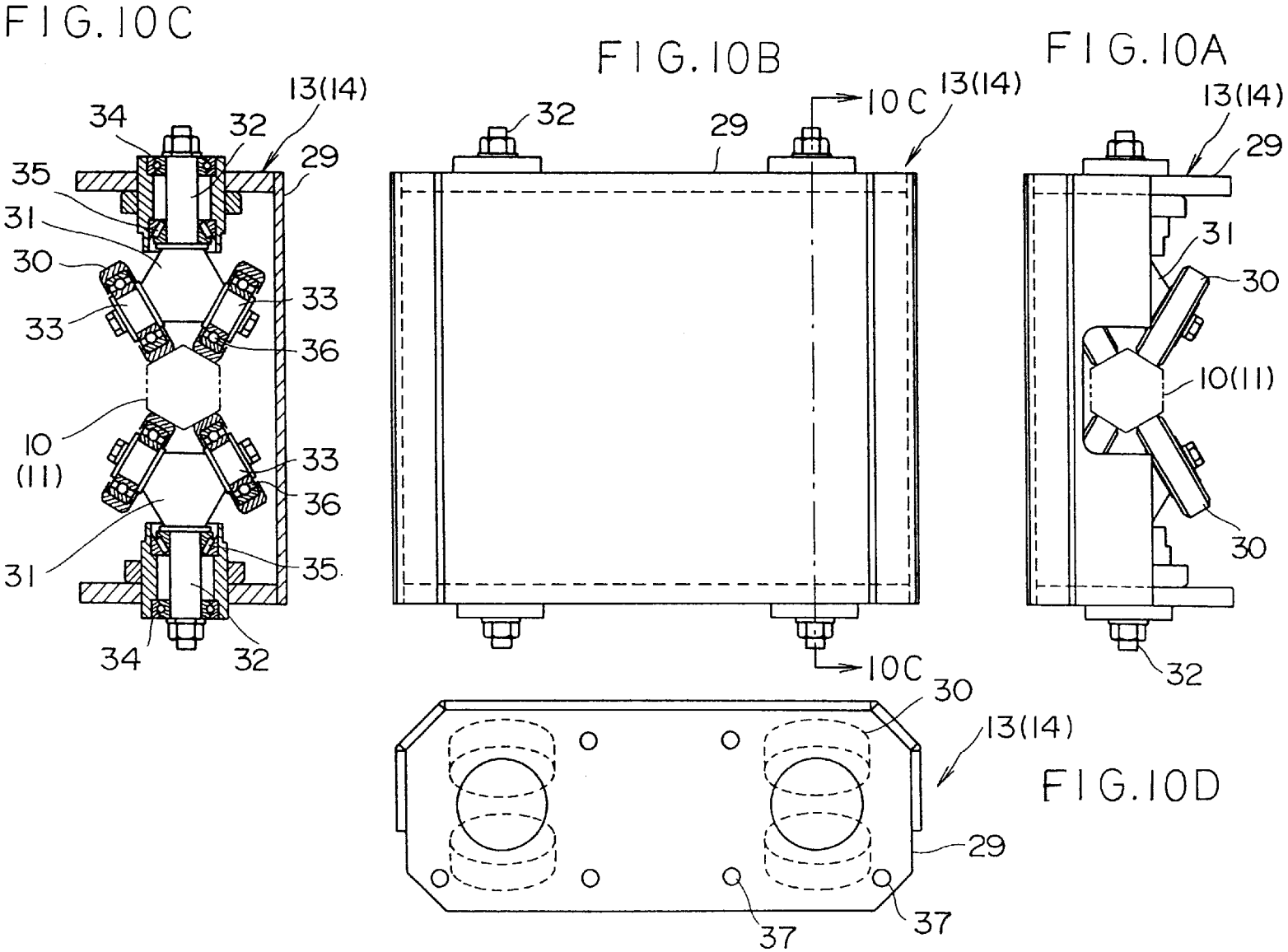

The upper and lower suspension devices 13 and 14 are of the same structure. As shown in FIGS. 10A through 10D, each of the upper and lower suspension devices 13 and 14 includes a solid box 29 and four wheel supports 31 disposed within the box 29. Each of the wheel supports 31 has three radially extending shafts angularly spaced by 120° from each other. One of the shafts, 32, extends vertically and is rotatably supported by bearings 34 and 35 secured to the box 29, and the other two act as axles 33 for rotatably supporting respective wheels 30 through respective bearings 36. Two such wheel supports 31 are disposed in the upper portion in the inner space of the box 29, and the remaining two are disposed in the lower portion of the box 29. The upper two wheel supports 31 and the lower two wheel supports 31 are disposed to face the other two. As shown in FIG. 10C, four of the wheels 30 are arranged in such a manner that their outer peripheral surfaces contact with the upper or lower rail 10 or 11 at locations in a plane perpendicular to the length of the rail, and the remaining four wheels 30 are similarly arranged in such a manner that their outer peripheral surfaces contact the upper or lower rail 10 or 11 at locations in a transverse plane different from the above-mentioned one. Thus, two sets of four wheels 30, i.e. eight wheels 30 are disposed in each of the upper and lower suspension devices 13 and 14 or in each box 29, and the two wheel sets are contacting the rail 10 or 11 at different locations.

In FIG. 10D, screw holes 37 are formed in the box 29 for use in securing a coupling member 39 of the carrier bar 15 or a coupling member 40 of a lower door support 42, which will be described in detail later. The upper and lower suspension devices 13 and 14 engage with the upper and lower rails 10 and 11, respectively. The carrier bar 15 is coupled to the upper suspension device 13, and the lower door support 42 is coupled to the lower suspension device 14. A set of one such upper suspension device 13 and one such lower suspension device 14 is used for each door 12.

Figure 9C:
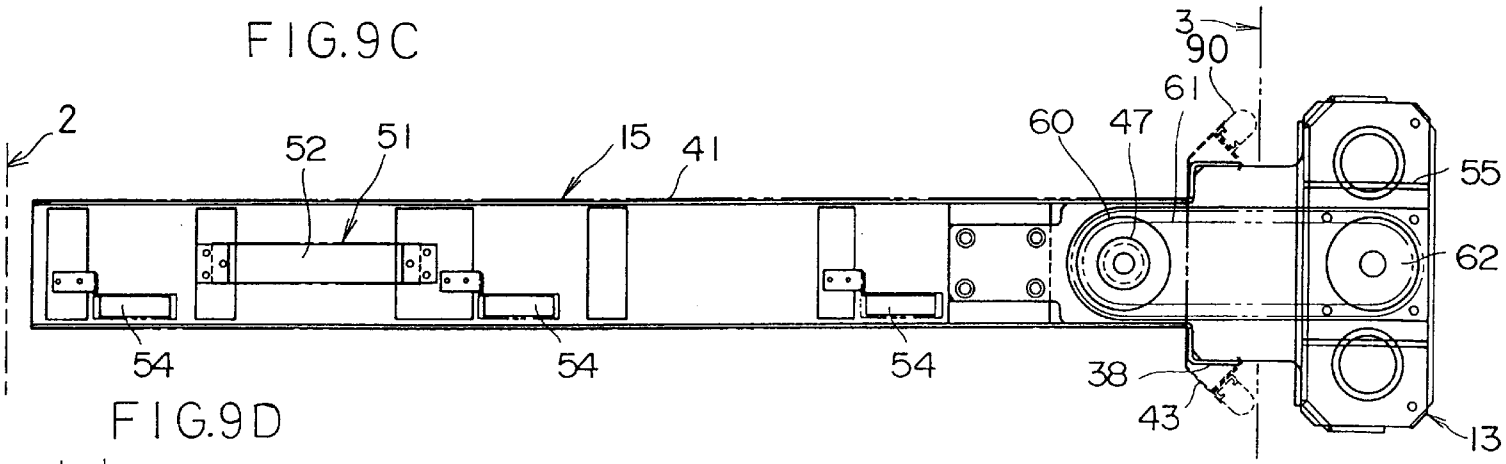
FIG. 9C is a cross-sectional view along the line 9C—9C in FIG. 7.
Figure 9B:
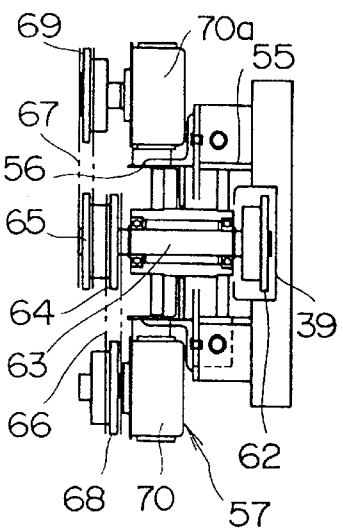
FIG. 9B is a right side view of the portion shown in FIG. 9A.
Figure 9A:
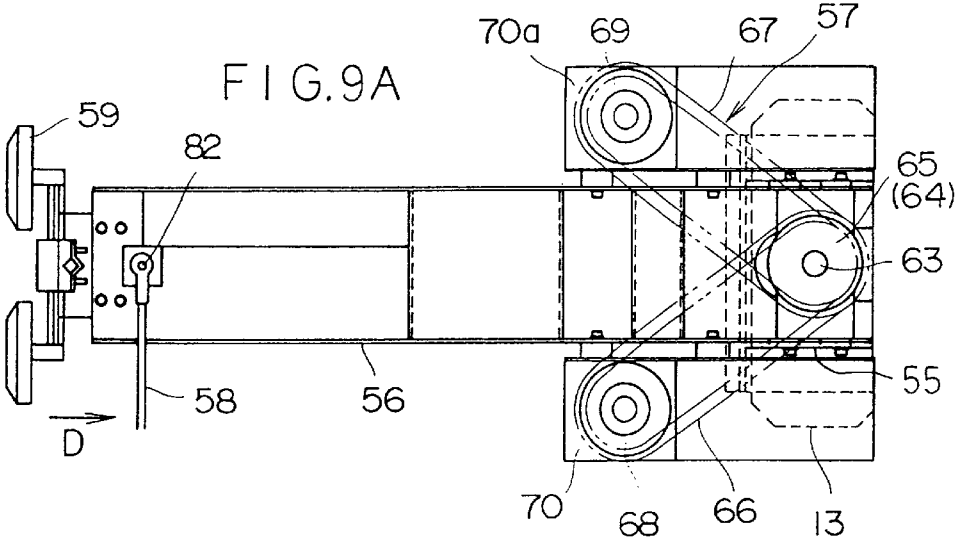
FIG. 9A is an enlarged plan view of a portion of the revolving door system shown in FIG. 1 around a pulling bar.

Each carrier bar 15 is formed of a horizontally extending hollow body 41 in the shape of quadratic prism. The carrier bar 15 extends along the lower surface 4 of the ceiling member 4, as shown in FIGS. 7 and 9C, and has a length approximately equal to the width of the door 12, a width larger than the thickness of the door 12, and a predetermined height. The carrier bar 15 has a free end located near the outer wall 2. The carrier bar 15 extends into the center core 3. The above-mentioned coupling member 39 coupled to the associated upper suspension device 13 is disposed at the end of the carrier bar 15 located in the center core 3.

The lower door support 42 is a member supporting the lower end of the center core side of the door 12, as shown in FIG. 8, and has the above-mentioned coupling member 40 vertically facing the coupling member 39. The lower door support 42 is coupled to the lower suspension device 14 via the coupling member 40. The carrier bar 15 and the lower door support 42 are interconnected by a vertical support 38. The vertical support 38 has a length corresponding to the vertical dimension of the door 12 and is formed of a member having a shallow U-shaped cross-section, as shown in FIG. 9C. The vertical support 38 is provided with an outer cover 43 so that it appears to extend in the vicinity of and along the outer surface of the center core 3, to have a concave surface facing the center core 3, and to have a flat shape having a width slightly larger than the thickness of the door 12. A rubber-like member 90 is attached to the both side edges of the outer cover 43.

The coupling member 39 is directly coupled to the upper suspension device 13, while the lower coupling member 40 is coupled to the lower suspension device 14 through rubber bushes 44 which can contract and expand and act as an error absorbing device. (Such error absorbing device may be disposed between the upper suspension device 13 and the coupling member 39.) The upper and lower coupling members 39 and 40 extend into the center core 3 through horizontal peripheral openings 45 and 46, respectively, in the wall of the center core 3. The openings 45 and 46 extend entirely around the center core 3. The rubber bushes 44 absorb errors, such as errors in parallelism between the upper and lower rails 10 and 11 and errors which could occur in assembling the upper and lower suspension devices 13 and 14, so that the door 12 and the carrier bar 15 can move smoothly on the rails. In the illustrated example, each of the upper and lower suspension devices 13 and 14 is arranged to clamp the rail 10 or 11 by the eight wheels 30. The spacing between the upper and lower rails 10 and 11 may vary more or less from location to location along their length, but such variations can be absorbed by the elastic deformation of the rubber bushes 44 to thereby prevent deformation and damage of other portions, and large increase of moving resistance of the door 12.

Upper and lower pivots 47 and 48 are provided to extend upward and downward from the top and bottom ends of the door 12 on the center core side. The center axes of the pivots 47 and 48 are vertically aligned. The upper pivot 47 extends into the inner space of the carrier bar 15 and has its upper end portion rotatably supported by a bearing 49. A sprocket 60 of a later-mentioned automatic door closing arrangement 57 is secured to the upper end of the pivot 47. The lower pivot 48 extends into the lower door support 42 and is rotatably supported by a bearing 50. The pivot 48 may be provided on the lower door support 42 with the bearing 50 disposed on the door 12. Thus, the door 12 is rotatable about the pivots 47 and 48.

As shown in FIG. 7, an electromagnetic door detention arrangement or electromagnetic locking arrangement 51 including a solenoid 52 and an iron piece member 53 is disposed in an area including the distal end portions of the hollow body 41 and the door 12 remote from the center core 3. The solenoid 52 is disposed within the hollow body 41 of the carrier bar 15, and the iron piece member 53 is secured to the upper portion of the door 12 at a location corresponding to the location of the solenoid 52 in the hollow body 41. The solenoid 52 operates to attract the iron piece member 53 to thereby detain the door 12 in place with respect to the carrier bar 15.

Within the hollow body 41 at locations near the forward side of the door 12, sensors 54 for sensing a human or an article present in front of the door 12 are disposed. The sensors 54, when sensing a human or an article in front of the door 12, generate an object representative signal, which may be used to stop the door system, for example. If necessary, similar sensors may be provided in the lower portion of the vertical support 38.

A short linking member 55 protrudes upward from the top of the coupling member 39 of the carrier bar 15 beyond the upper edge of the center core 3. A pulling bar 56 formed of an upward opening, generally U-shaped member is secured to the top end of the linking member 55, so that the carrier bar 15 and the pulling bar 56 are coupled to each other via the linking member 55. The pulling bar 56 extends within the ceiling member 4 in parallel with the carrier bar 15, from the linking member 55 to a position slightly outward of the midpoint of the width of the door 12. The automatic door closing arrangement 57, a connecting rod 58, and a signal transmitting slider 59 are disposed on the pulling bar 56, as shown in FIGS. 7, 9A, 9B and 9C. When the electromagnetic door detention arrangement 51 is disabled, the door 12 can be swung open about the pivots 47 and 48 in either direction by external force exerted to it. When the door 12 is swung open, the rotation of the door 12 is transmitted through the sprocket 60, a chain 61 engaging with the sprocket 60, a sprocket 62 engaged with by the chain 61, a shaft 63 to which the sprocket 62 is secured, one of sprockets 64 and 65 secured to the shaft 63, and associated one of chains 66 and 67 engaging with the sprockets 64 and 65, respectively, to associated one of sprockets 68 and 69 on main bodies 70 and 70*a*. The rotation of the door 12 transmitted to the sprocket 68 or 69 is stored in a spring (not shown) disposed within the main body 70 or 70*a*. When the external force is removed from the door 12, the spring releases the energy stored in it so that the door 12 is returned to its original position. The two sets of sprocket and chain arrangements, namely, the sprockets 64 and 65, the chains 66 and 67, and the sprockets 68 and 69, are used to return the door 12 to its original position regardless of the direction of the swing of the door 12. When the door 12 is swung open in one direction by external force, the sprocket 60, the chain 61, the sprocket 62, the shaft 63, the sprocket 64, the chain 66, the sprocket 68 and the associated spring in the main body 70 operate, and, if the door 12 is swung open in the opposite direction, the sprocket 60, the chain 61, the sprocket 62, the shaft 63, the sprocket 65, the chain 67, the sprocket 69 and the associated spring in the main body 70*a* operate.

The door driving arrangement 16 includes, as shown in FIGS. 4, 5 and 6, a plurality of sprockets 72 rotatably supported by associated sprocket supports 71 which, in turn, are secured to appropriate locations of the skeleton 8 within the ceiling member 4, a driving chain 75 disposed to engage with the respective sprockets 72, and a rotation driver 76 mounted on a predetermined one, 72A, of the sprockets 72. The driving chain 75 moves along straight paths 73 and along generally arcuate paths 74, as shown in FIG. 5. The driver 76 includes an electric motor 77 mounted within the center core 3, a sprocket 79 having a smaller diameter secured to a rotation shaft 78 of the motor 77, a sprocket 80 having a larger diameter secured to the shaft of the predetermined sprocket 72A, and a driving force transmitting chain 81 wrapped around the sprockets 79 and 80. As the motor 77 rotates, the driving chain 75 is driven at a reduced speed.

Figure 9D:
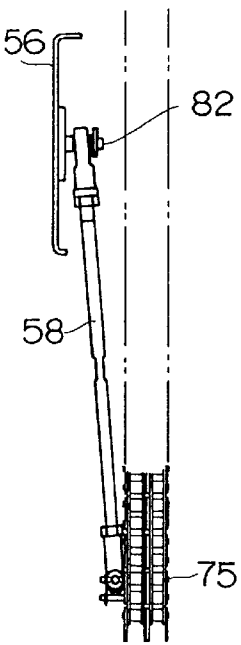
FIG. 9D is an enlarged view of the portion shown in FIG. 9A when viewed in the direction indicated by an arrow D in FIG. 9A.

As shown in FIG. 9D, the connecting rods 58 equal in number to the carrier bars 15, four in the illustrated example, are secured to the driving chain 75 at predetermined intervals.

The connecting rod 58 has its one end coupled to the pulling bar 56 in such a manner as to be rotatable about a vertically extending pivot 82 secured to the pulling bar 56. The connecting rod 58 is connected to the pulling bar 56 at a location which is above the midpoint of the width of the door 12 when the door 12 is electromagnetically detained in place with respect to the carrier bar 15. The other end of the connecting rod 58 is connected to the driving chain 75 of the door driving arrangement 16.

The four connecting rods 58 for the respective ones of the four doors 12 are connected to the driving chain 75 at locations spaced at equal intervals. Thus, the doors 12 supported by the respective carrier bars 15 can assume respective positions shown in FIG. 2 where they close the opposite ends of the passageways 6 and 7 during the course of the movement described later.

A control unit (not shown) controls the revolving door system 1 with the above-described door supporting arrangement 9 in such a manner that the respective doors 12 may assume the respective positions shown in FIG. 2 where the opposite ends of each of the passageways 6 and 7 are closed, when no one is entering or exiting through the passageway 6 or 7, and that when a human is approaching the passageway 6 or 7, the doors 12 move in the predetermined direction indicated by arrows so that he or she can enter or exit from the building. When he or she has left the revolving door system 1, the revolving door system assumes again the position shown in FIG. 2 and remains therein.

The doors 12 are moved by the operation of the door driving arrangement 16. As the door driving arrangement 16 is activated, the driving chain 75 travels in a predetermined direction at a predetermined speed, which drives the connecting rods 58 and, hence, the pulling bars 56 . Then, the carrier bars 15 connected to the pulling bars 56, the linking member 55, the upper suspension device 13, the lower suspension device 14, the lower supports 42, the vertical supports 38 etc. move, together with the associated doors 12, along the upper and lower rails 10 and 11.

In the normal operating state, the doors 12 are detained in position by the associated electromagnetic door detention arrangements 51. In this state, the upper and lower pivots 47 and 48 of each door 12 are rotatably supported by the bearings 49 and 50 disposed on the associated carrier bar 15 and lower door support 42. Some detaining force is applied to the upper pivot 47 by the automatic door closing arrangement 57 to detain the door 12 in place. The electromagnetic door detention arrangement 51 adds a locking force to electromagnetically couple the carrier bar 15 to the door 12. The carrier bar 15 is coupled to the upper suspension device 13 and to the lower suspension device 14 via the vertical support 38. Thus, each door 12 is so firmly detained in place shown in, for example, FIG. 2, being supported at the three points, that even when external force, e.g. wind pressure, is applied to the door 12, it is detained in place. The vertical supports 38 provide better holding of the doors 12, but they may be eliminated depending on the site where the revolving door system is installed, the weight of the doors 12, the strength of each of the parts of the door supporting arrangement.

With the electromagnetic door detention arrangement 51 of a particular one of the doors 12 disabled, that door can be rotated open against the detaining force provided by the automatic door closing arrangement 57 about the upper and lower pivots 47 and 48. Accordingly, when the revolving door system 1 stops for some reason, and, therefore, a person is confined in a space between the two doors 12, the electromagnetic door detention arrangement 51 of either or both of the two doors 12 is disabled, which permits either or both doors to be opened manually. The manually opened door 12 is automatically closed by the automatic door closing arrangement 57 when the manual force exerted to the door 12 is removed. Then, the operation of the revolving door system 1 can be resumed upon removal of the cause that stopped the system 1.

Each of the carrier bars 15 is hollow and can house its associated components, such as the solenoid 52 of the electromagnetic door detention arrangement 51, the sensor 54, the bearing 49, the sprocket 60 and the chain 61 of the automatic door closing arrangement 57, whereby the appearance of each door 12 is not marred.

What is claimed is:

1. A revolving door system for installation in a doorway defined by an opening in a wall of a building, said revolving door system comprising:

a pair of outer walls of substantially equal length and height, each outer wall being attachable to a side of the doorway in a position which is substantially perpendicular to said building wall;

a hollow center core disposed between said outer walls, said center core comprising a pair of side walls positioned in substantially parallel spaced relationship to said outer walls, each side wall having a length substantially equal to the length of each of said outer wall, said center core further comprising two curved end portions, each curved end portion connecting respective adjacent ends of said side walls, said side walls and end portions forming an outer surface of said hollow center core;

a ceiling member extending above said center core and said outer walls, said ceiling member, said center core and said outer walls defining two passageways for the doorway, each on a respective side of said center core:

upper and lower rails disposed on said center core, said rails extending horizontally around and parallel with the outer surface of said center core;

a plurality of doors, each door having an upper portion and a lower portion;

each door including upper and lower suspension devices, attached to said upper and lower portions respectively of said door, said upper and lower suspension devices being movably engaged with said upper and lower rails, respectively, so as lo enable movement along said upper and lower rails, thereby enabling movement of each of said doors along said passageways;

a door driving chain coupled to said upper suspension devices through pulling bars and moving along a predetermined path;

a rotation driver coupled to said door driving chain for driving said chain along said predetermined path; and each door including a door supporting structure, each of said door supporting structures comprising a carrier bar coupled to a respective one of said upper suspension devices, each of said carrier bars extending in parallel with a plane defined by said ceiling member and having a length substantially equal to a width of each door;

each of said carrier bars being attached to the upper portion of a respective one of said doors and rotatably supporting said door at an end portion of said door proximate said center core and detachably holding an end portion of said door distal from said center core; and the lower portion of each of said doors being rotatably supported by a respective one of said lower suspension devices which is attached to said end portion of said door proximate said center core.

2. The revolving door system according to claim 1 wherein each of said carrier bars electromagnetically detachably holds a respective one of said end portions of said doors distal to said center core.

3. A revolving door system for installation in a doorway defined by an opening in a wall of a building, said revolving door system comprising:

a pair of outer walls of substantially equal length and height, each outer wall being attachable to a side of the doorway in a position which is substantially perpendicular to said building wall;

a hollow center core disposed between said outer walls, said center core comprising a pair of side walls positioned in substantially parallel spaced relationship to said outer walls, each side wall having a length substantially equal to the length of each of said outer walls, said center core further comprising two curved end portions, each curved end portion connecting respective adjacent ends of said side walls, said side walls and end portions forming an outer surface of said hollow center core;

a ceiling member extending above said center core and said outer walls, said ceiling member, said center core and said outer walls defining two passageways for the doorway, each on a respective side of said center core;

upper and lower rails disposed on said center core, said rails extending horizontally around and parallel with the outer surface of said center core;

a plurality of doors, each door having an upper portion and a lower portion;

each door including, upper and lower suspension devices attached to said upper and lower portions respectively of said door, said upper and lower suspension devices being movably engaged with said upper and lower rails, respectively, so as to enable movement along said upper and lower rails, thereby enabling movement of each of said doors along said passageways;

a door driving chain coupled to said upper suspension devices through pulling bars and moving along a predetermined path;

a rotation driver coupled to said door driving chain for driving said chain along said predetermined path; and each door including a door supporting structure, each of said door supporting structures comprising a carrier bar coupled to a respective of said upper suspension devices, each of said carrier bars extending in parallel with a plane defined by said ceiling member and having a length substantially equal to a width of each door, each of said door supporting structures further comprising a vertical support secured to an end portion of said carrier bar, proximate said center core each vertical support extending in parallel with the outer surface of said center core and having a lower end portion thereof connected to a respective one if said lower suspension devices;

each of said carrier bars being attached to the upper portion of a respective one of said doors and rotatably supporting said door at an end portion of said door proximate said center core and detachably holding an end portion of said door distal from said center core; and the lower portion of each of said doors being rotatably supported by a respective one of said lower suspension devices which is attached to said end portion of said door proximate said center core.

4. The revolving door system according to claim 3 wherein each of said carrier bars electromagnetically detachably holds a respective one of said end portions of said doors distal to said center core.

5. A revolving door system for installation in a doorway defined by an opening in a wall of a building, said revolving door system comprising:

a pair of outer walls of the substantially equal length and height, each outer wall being attachable to a side of doorway in a position which is substantially perpendicular to said building wall;

a hollow center core disposed between said outer walls, said center core comprising a pair of side walls positioned in substantially parallel spaced relationship to said outer walls each side wall having a length substantially equal to the length of each of said outer walls, said center core further comprising two curved end portions, each curved end portion connecting respective adjacent ends of said side walls, said side walls and end portions forming an outer surface of said hollow center core;

a ceiling member extending above said center core and said outer walls, said ceiling member, said-floor, said center core and said outer walls defining two passageways for the doorway, each on a respective side of said center core;

upper and lower rails disposed on said center core, said rails extending horizontally around and parallel with the outer surface of said center core;

a plurality of doors, each door having an upper portion and a lower portion;

each door including upper and lower suspension devices, attached to said upper and lower portions respectively of said door, said upper and lower suspension devices being movably engaged with said upper and lower rails, respectively, so as to enable movement along said upper and lower rails, thereby enabling movement of each of said doors along said passageways;

a door driving chain coupled to said upper suspension devices through pulling bars and moving along a predetermined path;

a rotation driver coupled to said door driving chain for driving said chain along said predetermined path: and each door including a door supporting structure, each of said door supporting structures comprising a carrier bar coupled to a respective one of said upper suspension devices, each of said carrier bars extending in parallel with a plane defined by said ceiling member and having a length substantially equal to a width of each door and a width substantially equal to a thickness of each door;

each of said carrier bars being hollow and housing therein a bearing for rotatably supporting a respective one of the doors, an arrangement for magnetically detachably holding the door, and a sensor for sensing an object in a moving path of the door.

6. A revolving door system for installation in a doorway defined by an opening in a wall of a building, said revolving door system comprising, a pair of outer walls of substantially equal length and height, each outer wall being attachable to a side of the doorway in a position which is substantially perpendicular to said building wall;

a hollow center core disposed between said outer walls, said center core comprising a pair of side walls positioned in substantially parallel spaced relationship to said outer walls, each side wall having a length substantially equal to the length of each of said outer walls, said center core further comprising two curved end portions, each curved end portion connecting respective adjacent ends of said side walls, said side walls and end portions forming an outer surface of said hollow center core;

a ceiling member extending above said center core and said outer walls, said ceiling member, said center core and said outer walls defining two passageways for the doorway, each on a respective side of said center core;

upper and lower rails disposed on said center core, said rails extending horizontally around and parallel with the outer surface of said center core;

a plurality of doors, each door having an upper portion and a lower portion;

each door including upper and lower suspension devices, attached to said upper and lower portions respectively of said door, said upper and lower suspension devices being movably engaged with said upper and lower rails, respectively, so as to enable movement along said upper and lower rails, thereby enabling movement of each of said doors along said passageways;

a door driving chain coupled to said upper suspension devices through pulling bars and moving along a predetermined path.

a rotation driver coupled to said door driving chain for driving said chain along said predetermined path; and each door including a door supporting structure, each of said door supporting structures comprising a carrier bar coupled to a respective one of said upper suspension devices, each of said carrier bars extending in parallel with a plane defined by said ceiling member and having a length substantially equal to a width of each door;

each of said carrier bars being hollow and housing therein a bearing which rotatably supports a pivot secured to the upper portion of a respective one of the doors at an end portion of said door proximate said center core:

each of said doors including a spring biased automatic door closing arrangement for automatically pivoting said door about said pivot into a closed position, each of said automatic door closing arrangements being disposed within said ceiling member and extending in parallel with an associated one of said pulling bars, each of said pulling bars having a linkings member secured to an associated one of the carrier bars and to an associated one of the upper suspension devices.

7. A revolving door system for installation in a doorway defined by an opening in a wall of a building, said revolving door system comprising:

a pair of outer walls of substantially equal length and height, each outer wall being attachable to a side of the doorway in a position which is substantially perpendicular to said building wall;

a hollow center core disposed between said outer walls, said center core comprising a pair of side walls positioned in substantially parallel spaced relationship to said outer walls, each side wall having a length substantially equal to the length of each of said outer walls, said center core further comprising two curved end portions, each carved end portion connecting respective adjacent ends of said side walls, said side walls and end portions forming an outer surface of said hollow center core;

a ceiling member extending above said center core and said outer walls, said ceiling member, said center core and said outer walls defining two passageways for the doorway, each on a respective side of said center core;

upper and lower rails disposed on said center core, said rails extending horizontally around and parallel with the outer surface of said center core;

a plurality of doors, each door having an upper portion and a lower portion;

each door including upper and lower suspension devices, attached to said upper and lower portions respectively of said upper and lower suspension devices being movably engaged with said upper and lower rails, respectively, so as to enable movement along said upper and lower rails, thereby enabling movement of each of said doors along said passageways;

a door driving chain coupled to said upper suspension devices through pulling bars and moving along a predetermined path;

a rotation driver coupled to said door driving chain for driving said chain along said predetermined path; and each door including a door supporting structure which pivotally supports said door at an end portion of said door proximate said center core and is supported by a respective pair of said upper and lower suspension devices, each of said door supporting structures further including an error absorbing device disposed between one of said respective pair of said upper and lower suspension devices and said door supporting structure for absorbing variations in distance between said one of said respective pair of said upper and lower suspension devices and said door supporting structure.

8. A revolving door system for installation in a doorway defined by an opening in a wall of a building, said revolving door system comprising:

a pair of outer walls of substantially equal length and height each outer wall being attachable to a side of the doorway and in a position which is substantially perpendicular to said building wall;

a hollow center core disposed between said outer walls, said center core comprising a pair of side walls positioned in substantially parallel spaced relationship to said outer walls, each side wall having a length substantially equal to the length of each of said outer walls, said center core further comprising two curved end portions, each curved end portion connecting respective adjacent ends of said side walls, said side walls and end portions forming an outer surface of said hollow center core;

a ceiling member extending above said center core and said outer walls, said ceiling member, said center core and said outer walls defining two passageways for the doorway, each on a respective side of said center core;

upper and lower rails disposed on said center core, said rails extending horizontally around and parallel with the outer surface of said center core;

a plurality of doors, each door having an upper portion and a lower portion;

each door including upper and lower suspension devices, attached to said upper and lower portions respectively of said door, said upper and lower suspension devices being movably engaged with said upper and lower rails, respectively, so as to enable movement along said upper and lower rails, thereby enabling movement of each of said doors along said passageways;

a door driving chain coupled to said upper suspension devices through pulling bars and moving along a predetermined path;

a rotation driver coupled to said door driving chain for driving said chain along said predetermined path; and each door including a door supporting structure, each of said door supporting structures comprising a carrier bar coupled to a respective one of said upper suspension devices, each of said carrier bars extending in parallel with a plane defined by said ceiling member and having a length substantially equal to a width of each door;

each of said carrier bars being attached to the upper portion of a respective one of said doors and rotatably supporting said door at an end portion of said door proximate said center core and detachably holding an end portion of said door distal from said center core;

the lower portion of each of said doors being rotatably supported by a respective one of said lower suspension devices which is attached to said end portion of said door proximate said center core;

each of said upper and lower suspension devices having two sets of four wheels, each set disposed within a rigid frame and rotatably supported by an associated wheel support, said four wheels in each set rotatably engaging with an associated one of said rails so that a respective one of said suspension devices can move along said associated rail, one set of said two sets of four wheels of each of said upper and lower suspension devices being spaced from the other set of said two sets of four wheels of a respective one of said upper and lower suspension devices along said associated rail.

* * * * *